US009771752B2

(12) United States Patent
Michaud

(10) Patent No.: US 9,771,752 B2
(45) Date of Patent: Sep. 26, 2017

(54) ADJUSTABLE GASKET ASSEMBLY

(71) Applicant: Donald A. Michaud, Marblehead, MA (US)

(72) Inventor: Donald A. Michaud, Marblehead, MA (US)

( * ) Notice: Subject to any disclaimer, the term of this patent is extended or adjusted under 35 U.S.C. 154(b) by 64 days.

(21) Appl. No.: 14/545,444

(22) Filed: May 5, 2015

(65) Prior Publication Data

US 2016/0326793 A1 Nov. 10, 2016

(51) Int. Cl.

| | |
|---|---|
| ***E06B 3/964*** | (2006.01) |
| ***E04B 1/684*** | (2006.01) |
| ***E06B 1/62*** | (2006.01) |
| ***E04B 1/64*** | (2006.01) |
| ***E04B 1/68*** | (2006.01) |
| ***E06B 3/54*** | (2006.01) |

(52) U.S. Cl.

CPC ..... *E06B 1/62* (2013.01); *E04B 1/64* (2013.01); *E04B 1/6803* (2013.01); *E06B 3/549* (2013.01); *E06B 2001/628* (2013.01)

(58) Field of Classification Search

CPC . E06B 1/62; E06B 1/68; E06B 1/6069; E06B 2001/622; E06B 2001/628

See application file for complete search history.

(56) References Cited

U.S. PATENT DOCUMENTS 5,119,609 A * 6/1992 Tait ..... E06B 1/6015 206/321
5,590,496 A * 1/1997 Martin ..... E06B 1/6015 206/321
6,148,584 A * 11/2000 Wilson ..... E04F 19/0463 52/211
6,691,461 B1 * 2/2004 Gitkin ..... E06B 9/04 49/505

(Continued)

FOREIGN PATENT DOCUMENTS

EP 1992776 * 11/2008
FR 2623223 * 5/1989

OTHER PUBLICATIONS

Tremco Proglaze ETA—System 3; Drawing No. 08078; TR-16423S 40 Durometer Dense Translucent Silicone; Jul. 14, 2008.

(Continued)

*Primary Examiner* — Christine T Cajilig
(74) *Attorney, Agent, or Firm* — Don Halgren

(57) ABSTRACT

An elongated sealing assembly arranged to extend across a rectilinear rough opening in a wall of the building and a window frame for supporting a glass infill in that window frame, the elongated sealing assembly comprising an elongated extruded flexible panel having an elongated first edge, an elongated second edge, an elongated first side, an elongated second side, an elongated bituminous strip extending adjacent a second edge on the first side of the flexible panel, an elongated bituminous strip extending along a first edge on (Continued)

the first side of the flexible panel, an elongated dart flange extending perpendicularly outwardly from the first side of the flexible panel adjacent the elongated bituminous strip thereat, and an elongated, thickness-adjustable assembly coextruded with the elongated extruded flexible panel to permit in-field accommodation with adjacent yet spaced apart gaskets with respect to the support of a glass infill in the window frame.

5 Claims, 4 Drawing Sheets

(56) References Cited

U.S. PATENT DOCUMENTS

| | | | | |
|---|---|---|---|---|
| 7,654,046 | B2 * | 2/2010 | Ellingson | E04G 21/30 52/212 |
| 8,096,088 | B2 | 1/2012 | Poirier et al. | |
| 8,261,498 | B2 * | 9/2012 | Poirier | E06B 1/68 52/204.53 |
| 2003/0056444 | A1 * | 3/2003 | Ackerman, Jr. | E06B 1/62 52/58 |
| 2007/0193126 | A1 * | 8/2007 | Teodorovich | E04D 1/36 52/58 |
| 2008/0110110 | A1 * | 5/2008 | Burton | E06B 1/58 52/213 |
| 2008/0141597 | A1 * | 6/2008 | O'Rourke | E06B 1/62 52/62 |
| 2013/0008106 | A1 * | 1/2013 | Michaud | E06B 1/68 52/213 |

OTHER PUBLICATIONS

Tremco Proglaze ETA—System 3; Drawing No. 08079; Head Condition; Sill Condition; Jamb Condition; Jul. 16, 2008.

* cited by examiner

ADJUSTABLE GASKET ASSEMBLY

BACKGROUND OF THE INVENTION

Field of the Invention

This invention relates to building construction, and more particularly to apparatus and methods for sealing openings around window and door members by the adaptation of an installation assembly for those windows and doors as best fitted to the buildings receptive conditions, the present application being a continuation-in-part application of application Ser. No. 13/573,421, filed on Sep. 15, 2012, now U.S. Pat. No. 9,021,753, issued May 5, 2015, which is a continuation-in-part application of application Ser. No. 12/924,062, now U.S. Pat. No. 8,272,117, issued on 25 Sep. 2012, which is a divisional application of U.S. Pat. No. 7,797,891 issued on 21 Sep. 2010, each of which are incorporated by reference herein, in their entirety.

DISCUSSION OF THE ART

Modern building codes require a peripheral gap between the frame of a window and that windows rough opening. Such gaps may be between 1 to 3 inches. These gaps are required in order to provide a safety zone around those windows to accommodate building settling, shifting, environmental conditions and seismic events.

Those peripheral gaps around the windows need to be sealed to shut out or shut in environmental characteristics or conditions which may be detrimental or favorable to the buildings and its occupants well-being.

An example of the prior art attempting to satisfy these code requirements is shown in U.S. Pat. No. 8,096,088 to Poirer et al, incorporated by reference herein. This '088 patent discloses a sealing membrane extending between a portion of the wall of the building and an adapter attached to the side of the window frame. This is a rather complicated setup requiring assembly and components which are unnecessary. Other art merely propose a flat flexible membrane extending between a portion of the wall and a receiving channel on the window frame. Typically these window frames have perimeter gaskets between the filler or glass and the window frame. The glass or filler is typically held against the outer face of the window frame by elongated pressure plates extending peripherally therearound. Changing construction dimensional conditions often require these gap-crossing sealing membranes to be removed and or selected to be an alternate thickness to evenly accommodate the thickness of the perimeter gaskets between the class filler and the window frame or otherwise the elongated pressure plates may be uneven, vibrate in the wind, and will lose their ability to secure the window to the frame and lose their ability to properly seal glass to the frame.

It is an object of the present invention to overcome the disadvantages of the prior art.

It is a further object of the present invention to provide a gap-crossing membrane which will provide the proper depth of a gasket accommodation to that perimeter gasket parallel thereto.

It is yet a further object of the present invention to provide a gap-crossing membrane which is easy to apply by the contractors working in the field.

It is yet still another object of the present invention to provide a gap-crossing membrane which is variable in its thickness.

It is still yet a further object of the present invention to provide a gap crossing membrane which has improved sealing capabilities with minimal contractor effort at the assembly site.

BRIEF SUMMARY OF THE INVENTION

The present invention relates to insertable gap-crossing membranes or transition sealing assemblies utilized for sealing an entire peripheral gap or space between a window frame and the rough opening of a wall in a commercial building. That empty perimeter space is a design code requirement utilized to accommodate building settlement, movement through wind torque and seismic events. The window fitted into that space of course has to be supported therein, and sealed peripherally therearound by the sealing assembly of the present invention. The sealing assembly comprises an extruded, elongated, generally rectilinearly shaped flexible polymer body comprised of silicone, EPDM rubber gasket or other flexible polymer which extends between the building's air vapor barrier already in place on the building wall and an elongated attachment configuration arranged within the aluminum window frame which surrounds the inner wall of the rough opening of the building, spanning the peripheral gap therebetween.

The attachment configuration embodied in the aluminum window frame comprises an elongated dart-receiving channel or reglet, either on or immediately adjacent the spaced apart sidewall of the rough window opening. The sealing assembly may be comprised of extruded flexible air/vapor impermeable material or other flexible foam air fin material has an elongated dart flange spaced apart from a first elongated edge thereof and directed perpendicularly away from a first side thereof. An elongated bituminous asphalt strip is disposed on the first side of the sealing assembly between the elongated dart flange and the elongated first edge thereof. An elongated bituminous asphalt strip is disposed on the first side of the sealing assembly adjacent an elongated second edge thereof, which bituminous strips are utilized for adhering and sealing the sealing assembly against the air-vapor barrier on the wall and an elongated portion of the window frame.

An elongated thickness-adjusting layer assembly comprised of elongated peel-off thickness strips is disposed on a second side of the elongated sealing assembly directly opposite the elongated dart flange, coextruded with that dart flange which extends from the first side of the sealing assembly to permit adjustability when applying the sealing gasket in the field, relative to a parallel, adjacent dissimilar gasket which is attached between the window and the window frame.

The assembly of a building may for our purposes here, be "generally" characterized by steps such as building the interior wall of that building structure; wrapping the interior wall on its exterior side thereof with an air vapor barrier; installing a window frame within the rough opening of a window location; installing the sealing assembly between the exterior side of the air vapor barrier on the interior wall and the reglet or the elongated dart flange receiving channels on the outer face of the window frame; attaching a glass panel infill against the exterior side of the aluminum window frame with an elongated gasket extending between the glass and a parallel second reglet therein; attaching a pressure plate against the outer side of the sealing assembly and the outer side of the glass infill, the glass infill having an elongated gasket therewith, wherein the pressure plate is screwed to the main window frame and an elongated snap frame applied to the outer side of the pressure plate. A polyethylene backer rod and sealant is applied to the space between the exterior masonry and the side edge of the pressure plate, thus completing the basic assembly and sealing of the peripheral gap between the window frame and the perimeter of the rough opening in the wall of the building.

The invention thus comprises an elongated sealing assembly arranged to extend across a rectilinear rough opening in a wall of the building and a window frame for supporting a glass infill in that window frame, the elongated sealing assembly comprising: an elongated extruded flexible panel having an elongated first edge, an elongated second edge, an elongated first side, an elongated second side, an elongated bituminous strip extending adjacent a second edge on the first side of the flexible panel, an elongated bituminous strip extending along a first edge on the first side of the flexible panel, an elongated dart flange extending perpendicularly outwardly from the first side of the flexible panel adjacent the elongated bituminous strip thereat, and an elongated, thickness-adjustable assembly coextruded with the elongated extruded flexible panel to permit in-field accommodation with adjacent yet spaced apart gaskets with respect to the support of a glass infill in the window frame, wherein the thickness adjustable assembly comprises a plurality of coextruded, elongated peel off thickness strips. The thickness strips are defined by an elongated slit arranged between one another. Each elongated slit arranged between adjacent thickness strips may be of diminishing depth. The diminishing depth of the elongated slits diminish closer to the second side of the extruded flexible panel.

The invention also comprises a method of accommodating in-field variations in the thickness of an elongated sealing assembly and a further elongated sealing gasket applied against a window wherein the sealing assembly extends across a rough opening in a building wall and an aluminum frame for enclosing a window therein, comprising the steps of: attaching an elongated strip of bituminous asphalt on an elongated sealing assembly to an air vapor barrier on an exterior surface of a building wall; inserting an elongated dart flange of the elongated sealing assembly into a first elongated reglet of the elongated aluminum window frame; inserting an elongated dart flange of an elongated further gasket into a second elongated reglet on the elongated aluminum window frame; and adjusting the thickness of the elongated sealing assembly to correspond with the thickness of the elongated further gasket inserted into the second elongated reglet on the elongated window frame. The method may include peeling an elongated thickness strip from a second side of the elongated sealing assembly, and peeling an elongated thickness strip from a second side of the elongated sealing assembly, and/or peeling an elongated thickness strip from a second elongated thickness strip adjacent thereto. The difficulty of peeling an elongated thickness peel strip increases going from an outermost peel strip to an inner peel strip, to minimize the likelihood of peeling more strips than needed during a window installation procedure, because the amount of connective material at the lower end of the slit dividing the peel strips increases towards the frame side of the sealing assembly.

BRIEF DESCRIPTION OF THE DRAWINGS

The objects and advantages of the present invention will now become more apparent when viewed in conjunction with the following drawings, in which.

DETAILED DESCRIPTION OF THE PREFERRED EMBODIMENTS

Figure 1:
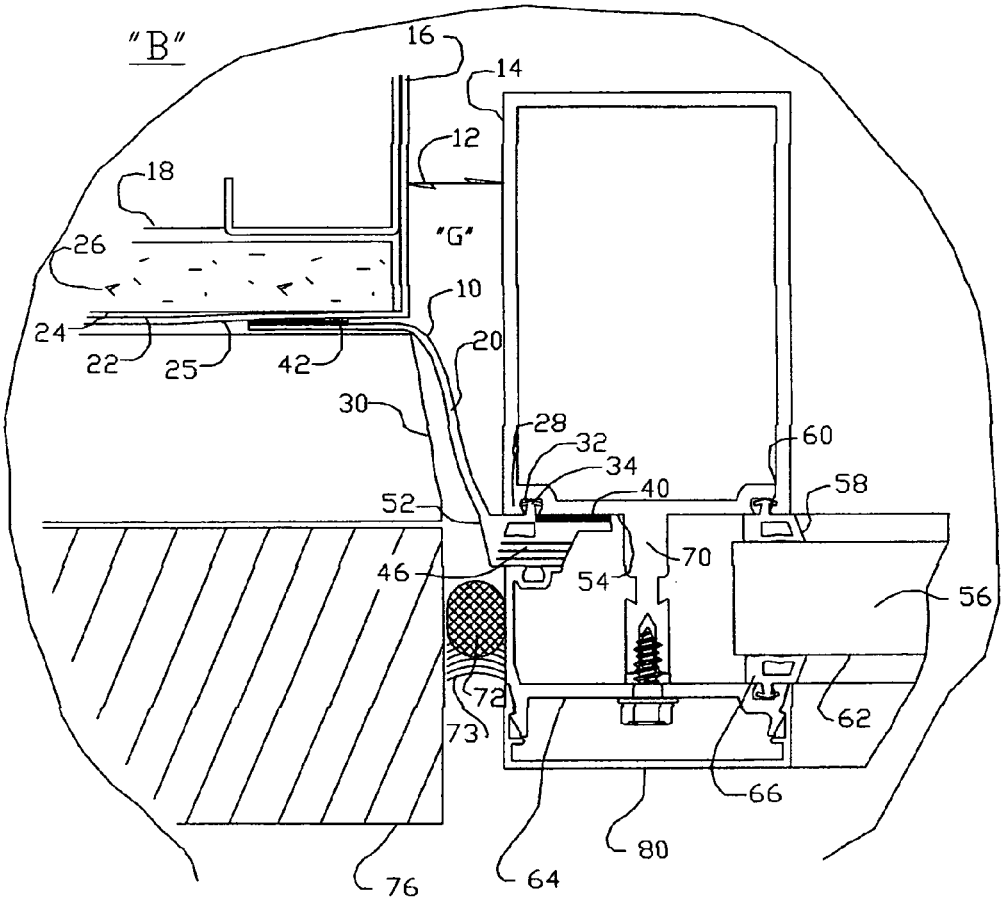
FIG. 1 is a cross-sectional view of the edge of a rough window opening of a wall of a commercial building, and an adjacent portion of an aluminum frame and window therewith.

Referring now to the drawings in detail and particularly to FIG. 1 there is shown the present invention comprising insertable gap-crossing membranes or transition sealing assemblies 10 utilized for sealing an entire peripheral gap or space 12 between a window frame 14 and the rough opening 16 of a wall 18 in a commercial building "B". That empty perimeter space 12 is a design code requirement utilized to accommodate building settlement, movement through wind torque and seismic events. The sealing assembly 10, shown perspectively in FIG. 2, comprises an extruded, elongated, generally rectilinearly shaped flexible polymer body 20 comprised of silicone, EPDM rubber gasket or other flexible polymer which extends between the building's air vapor barrier 22 already in place on the exterior side 24 of the interior portion 26 of the building wall 18, and an elongated attachment configuration 28 arranged within the aluminum window frame 14 which surrounds the inner wall 30 of the rough opening 16 of the building "B", spanning the peripheral gap "G" therebetween.

Figure 2:
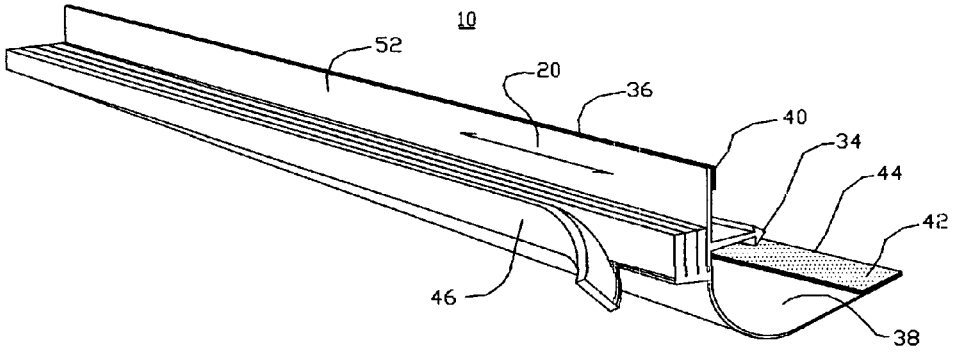
FIG. 2 is a perspective view of an elongated sealing assembly constructed according to the principles of the present invention.
Figure 3:
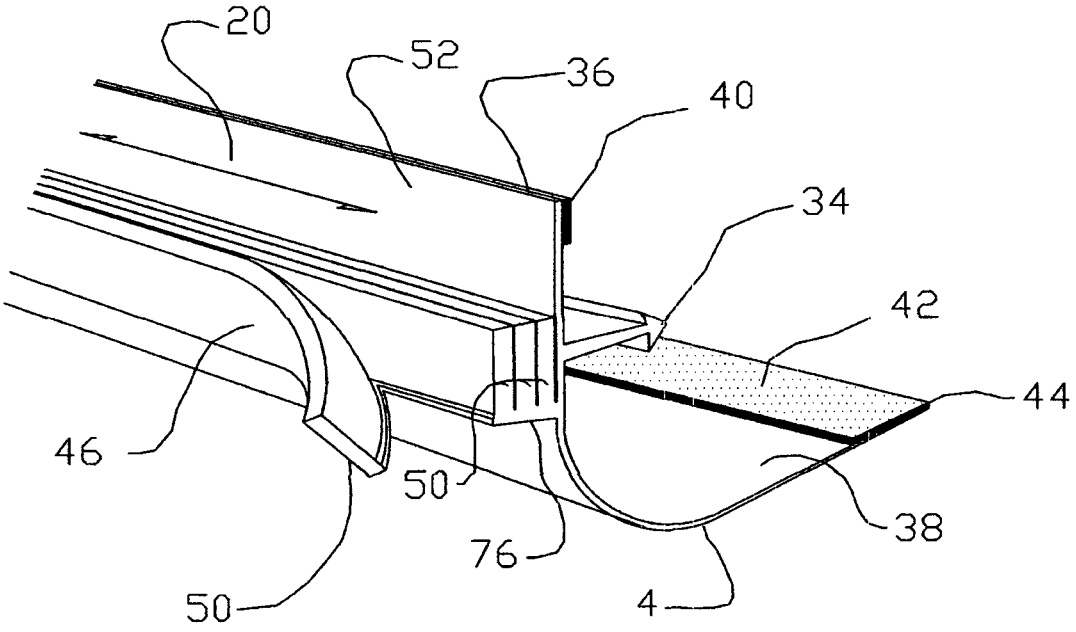
FIG. 3 is an enlarged perspective view of the elongated sealing assembly shown in FIG. 2.
Figure 4:
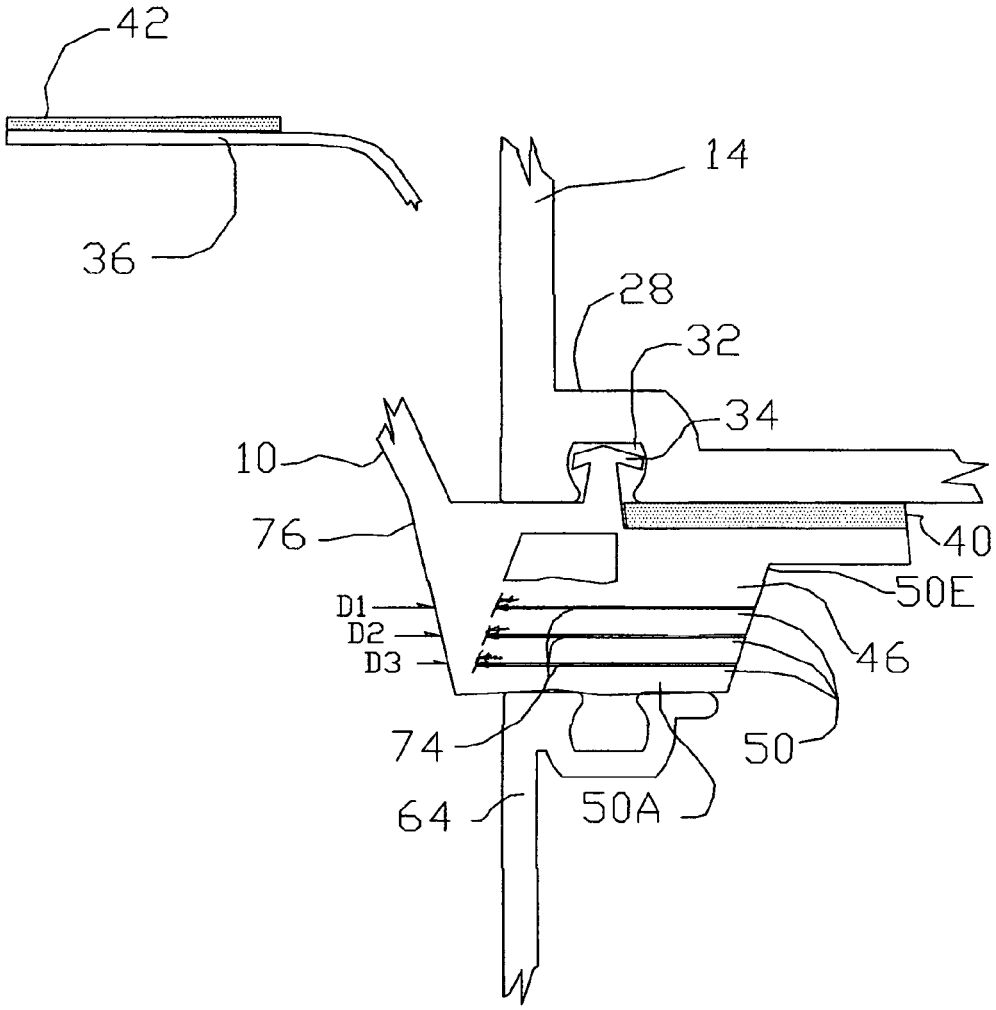
FIG. 4 is an enlarged end view of a sealing assembly showing the relationship of the elongated dart flange, a series of elongated peel-off thickness strips and the relationship of the sealing assembly to an adjacent, later attached pressure plate flange.

The attachment configuration 28 embodied in the aluminum window frame 14 comprises an elongated dart-receiving channel or reglet 32, either on or immediately adjacent the spaced apart sidewall of the rough window opening 30. The sealing assembly 10 which may be comprised of extruded air vapor impermeable flexible material or other flexible foam air fin material has an elongated dart flange 34, shown in FIG. 1, and more clearly in FIGS. 2, 3 and 4, spaced apart from a first elongated edge 36, thereof and directed perpendicularly away from a first side 38 thereof, as best seen in FIGS. 2, 3 and 4. An elongated bituminous asphalt strip 40 is disposed on the first side 38 of the sealing assembly 10 between the elongated dart flange 34 and the elongated first edge thereof 36, as shown in FIGS. 2 and 3. A second, elongated bituminous asphalt strip 42 is disposed on the first side 38 of the sealing assembly 10 adjacent an elongated second edge thereof 44.

An elongated thickness-adjusting layer assembly 46, comprised of elongated peel-off thickness-strips 50, is disposed on a second side 52 of the elongated sealing assembly 10 directly opposite the elongated dart flange 34 coextruded with and extending from the first side 38 of the sealing assembly 10, as best seen in FIGS. 3 and 4.

The assembly of a commercial type building may be generally and simply characterized by steps such as building the interior wall 18 of that building structure "B"; wrapping the interior wall 18 on the exterior side thereof, with an air vapor barrier 24, as represented in FIG. 1; installing a window frame 14 within the rough opening 16 of a window location; installing the sealing assembly 10 between the exterior side 25 of the air vapor barrier 24 on the interior wall 18 and the reglet or the elongated dart flange receiving channels 32 on the outer face 54 of the window frame 14; attaching a glass panel infill 56 against the exterior face 54 of the aluminum window frame 14 with an elongated, parallel, dart flange bearing gasket 58 of in-field, indeterminate thickness extending within a second reglet 60 and the glass 56; attaching a pressure plate 64 against the outer side 52 of the sealing assembly and the outer side 62 of the glass infill 56, the glass infill 56 having an elongated dart flange bearing gasket 66 there with, wherein the pressure plate 64 is screwed to an elongated co-extruded flange 70 on the main window frame; an elongated snap cap 80 snapped against and attached as a cover to the pressure plate 64, as may be evidenced in FIG. 1, and finally a backer rod 72 and sealant 73 are applied to the space between the exterior masonry 76 and to the side edge of the pressure plate 64, as may be seen in FIG. 1, thus completing the basic assembly and sealing of the peripheral gap "G" between the window frame 14 and the perimeter of the rough opening 16 in the wall of the building "B", the sealing assembly's 10 thickness being "adjusted" by removal of one or more pieces of elongated strip 50, as needed, to make the glass-securing pressure plate 64 evenly applied and properly aligned with respect to the window frame 14, thus avoiding any potential for wind induced misalignment chatter or worse.

A further embodiment of the peel-off thickness-strips 50 are defined by a parallel array of elongated slits 74 which are of decreasing depth "D" with respect to the backside 76 of the thickness-adjusting layer assembly 46, as represented in FIG. 4. The change in depth "D" going from outermost strip 50A to 50E makes the removal of the outermost strip 50A easier and less likely to pull off too many strips 50 when making on-the-fly, "in-field" gasket thickness accommodations between the sealing assembly 10 and its neighboring elongated gasket 58 which is contemporaneously applied during window installation, as may be appreciated upon viewing FIG. 1. That is, D1>D2>D3 etc. to help prevent accidental tearing off of too many strips 50. Unevenness between the thickness of the sealing assembly 10 at the peel-off strip location and the thickness of the elongated gasket 58 would otherwise cause the pressure plate 64 and possible the glass 56 to rattle, loosen or otherwise become a problem and not otherwise properly seal that glass 56.

The invention claimed is:

1. An elongated sealing assembly arranged to extend across a rectilinear rough opening in a wall of the building and a window frame, enabling the balanced, even support of a glass infill against that window frame by a gasketed pressure plate, the elongated sealing assembly comprising:

an elongated extruded flexible panel having an elongated first edge, an elongated second edge, an elongated first side, an elongated second side, an elongated second bituminous strip extending adjacent a second edge on the first side of the flexible panel, a first elongated bituminous strip extending along a first edge on the first side of the flexible panel, an elongated dart flange extending perpendicularly outwardly from the first side of the flexible panel adjacent the first elongated bituminous strip thereat, and an elongated, thickness-adjustable peel-off thickness strip assembly coextruded with the elongated extruded flexible panel, to permit in-field thickness-accommodation with a parallel, adjacent, spaced apart gasket to enable even support of a glass infill secured to the window frame by the pressure plate.

2. The elongated sealing assembly arranged to extend across a rectilinear rough opening in a wall of the building and a window frame for enabling the balanced even support of a glass infill in that window frame as recited in claim 1, wherein the thickness adjustable peel-off thickness strip assembly extends off of the second side of the elongated panel.

3. The elongated sealing assembly arranged to extend across a rectilinear rough opening in a wall of the building and a window frame for enabling the balanced, even support of a glass infill in that window frame as recited in claim 1, wherein the thickness strips are defined by an elongated slit arranged between one another.

4. The elongated sealing assembly arranged to extend across a rectilinear rough opening in a wall of the building and a window frame for enabling the balanced, even support of a glass infill in that window frame as recited in claim 2, wherein each elongated slit arranged between adjacent thickness strips are of differing depth.

5. The elongated sealing assembly arranged to extend across a rectilinear rough opening in a wall of the building and a window frame for enabling the balanced, even support of a glass infill in that window frame as recited in claim 3, wherein the differing depth of the elongated slits are reduced towards the second side of the extruded flexible panel.

* * * * *